US006204738B1

(12) United States Patent
Toda et al.

(10) Patent No.: US 6,204,738 B1
(45) Date of Patent: Mar. 20, 2001

(54) DIELECTRIC FILTER, DIELECTRIC DUPLEXER, MOUNTING STRUCTURE THEREOF, AND COMMUNICATION DEVICE

(75) Inventors: Jun Toda, Ishikawa-ken; Takashi Maruyama; Jinsei Ishihara, both of Kanazawa; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/291,923

(22) Filed: Apr. 14, 1999

(30) Foreign Application Priority Data

Apr. 17, 1998 (JP) ..... 10-108264
Feb. 22, 1999 (JP) ..... 11-042746

(51) Int. Cl.[7] ..... H01P 1/20; H01P 7/04; H01P 5/12

(52) U.S. Cl. ..... 333/206; 333/222; 333/134

(58) Field of Search ..... 333/202, 206, 333/222, 134

(56) References Cited

U.S. PATENT DOCUMENTS

| | | | | |
|---|---|---|---|---|
| 4,342,972 | | 8/1982 | Nishikawa et al. | 333/206 |
| 5,764,118 | * | 6/1998 | Saito et al. | 333/206 |
| 6,060,967 | * | 5/2000 | Asada | 333/202 |

OTHER PUBLICATIONS

Patent Abstracts of Japan, vol. 15, No. 355 (E–1109), Sep. 9, 1991 & JP 03 136502 A (Murata Mfg Co Ltd), Jun. 11, 1991, abstract.

Patent Abstracts of Japan, vol. 13, No. 333 (E–794), Jul. 26, 1989 & JP 01 097002 A (Fuji Electrochem Co Ltd), Apr. 14, 1989, abstract.

Patent Abstracts of Japan, vol. 17, No. 676 (E–1475), Dec. 13, 1993 & JP 05 226909 A (Sony Chem Corp), Sep. 3, 1993, abstract; figure 6, 7.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

The invention provides a dielectric filter, comprising: a dielectric block including a first surface and a second surface opposite to each other; a resonator hole extending between the first surface and second surface of the dielectric block, said resonator hole including a large-sectional area portion, a small-sectional area portion and a step portion between the large-sectional area portion and the small-sectional area portion; an inner conductor provided on the inner surface of the resonator hole; an outer conductor provided on the outer surface of the dielectric block; the inner conductor being electrically left unconnected to the outer conductor at the first surface of the dielectric block and being electrically connected to the outer conductor at the second surface of the dielectric block; and a seat portion provided on the first surface of the dielectric block such that the first surface serves as a mounting surface of the dielectric filter.

19 Claims, 8 Drawing Sheets

DIELECTRIC FILTER, DIELECTRIC DUPLEXER, MOUNTING STRUCTURE THEREOF, AND COMMUNICATION DEVICE

BACKGROUND OF THE INVENTION

1. Field of the Invention

The present invention relates to a dielectric filter, a dielectric duplexer, a mounting structure having the same, and a communication device.

2. Description of the Related Art

In recent years, radio wave communication equipment, such as portable telephones and the like, of small in size, light in weight, and thin types have been spread widely and rapidly. With the spread, it has been more intensively needed to develop dielectric filters and dielectric duplexers, to be mounted on the equipment of the above-mentioned type, which are small in size, light in weight, and low in height.

Conventionally, a dielectric filter of the above-mentioned type, shown in FIG. 11, has been known. A dielectric filter 8 comprises a plurality of resonator holes 3 provided in a single dielectric block 2 which has an outer conductor 1 provided on the surface thereof. An inner conductor 4 is provided on the inner surface of each resonator hole 3. The inner conductor 4 is electrically connected to the outer conductor 1, at the side surface 2*b* of the dielectric block 2, shown as the back-face of the dielectric filter 8 in FIG. 11, and is electrically left unconnected to the outer conductor 1 at the side surface 2*a* shown as the front-face in FIG. 11.

Ordinarily, the dielectric filter 8 is so mounted onto a circuit board 6 that the axes of the resonator holes 3 are in parallel to the circuit board 6. To reduce the height of the dielectric filter 8 having the above-described mounting form, the method may be supposed by which the diameters of the resonator holes 3 are decreased in order that the height h of the dielectric block 2 is reduced. However, it is difficult to form the dielectric block 2 by means of a metallic mould, due to the resonator holes 3 having a reduced diameter. In general, the dielectric filter 8 has a high $Q_0$. To obtain the high $Q_0$, it is necessary to assure the optimum height h with respect to the diameter of each resonator hole 3. For this reason, it is problematic to reduce the height of the dielectric filter 8. In some cases, an electromagnetic field leaking from the side surface 2*a*, which is an open-circuited surface, exerts a hazardous influence over the characteristics of other electronic components mounted onto a circuit board 6. Similarly, in some cases, an electromagnetic field leaking from the other electronic components unfavorably affects the characteristics of the dielectric filter 8.

SUMMARY OF THE INVENTION

Accordingly, it is an object of the present invention to provide a dielectric filter, a dielectric duplexer, a mounting structure having the same, and a communication device each of which is small in size, low in height, and has good characteristics.

To achieve the above object, the present invention provides a dielectric filter comprising: a dielectric block including a first surface and a second surface opposite to each other; a resonator hole extending between the first surface and second surface of the dielectric block, said resonator hole including a large-sectional area portion, a small-sectional area portion and a step portion between the large-sectional area portion and the small-sectional area portion; an inner conductor provided on the inner surface of the resonator hole; an outer conductor provided on the outer surface of the dielectric block; the inner conductor being electrically left unconnected to the outer conductor at the first surface of the dielectric block and being electrically connected to the outer conductor at the second surface of the dielectric block; and a seat portion provided on the first surface of the dielectric block to allow the first surface to serve as a mounting surface of the dielectric filter.

The present invention also provides a dielectric duplexer comprising the above described dielectric filter, wherein a plurality of said resonator holes are provided, at least one of which constituting a transmitting filter and at least the other one of which constituting a receiving filter.

According to the above described structure and arrangement, the dielectric filter or the dielectric duplexer is so mounted to a circuit board or the like that the axes of the resonator holes are substantially perpendicular to the circuit board or the like. In each resonator hole, the step portion is formed between the large-sectional area portion and the small-sectional area portion. The conductor path of the inner conductor is extended to lie on the surface of the step. Thus, the conductor path is longer by an amount corresponding to the step portion. Accordingly, the size of the dielectric filter or the dielectric duplexer can be reduced in the axial direction of the resonator hole, compared with the filter or duplexer which does not have such a step portion. Thus, the mounting height of the dielectric filter or the dielectric duplexer can be reduced. Further, a gap is formed between the first surface of the dielectric block which serves as the mounting surface, and the circuit board or the like, due to the seat portion provided on the first surface of the dielectric block. With the gap, a stray capacitance, produced between the first surface of the dielectric block and the circuit board, is reduced. In addition, since the first surface, which is the open-circuited surface, is opposed to the circuit board, an electromagnetic field leaking from the first surface can be inhibited from exerting an unfavorable influence over other electronic components mounted on the circuit board. Similarly, an electromagnetic field leaking from the other electronic components can be inhibited from affecting the dielectric filter or the dielectric duplexer.

A depression may be provided on the step portion between the large-sectional area portion and the small-sectional area portion of each resonator hole, and the conductor path of the inner conductor is extended to lie on the surface of the depression on the step. Thus, the conductor path is longer by an amount corresponding to the depression. Accordingly, the size of the dielectric filter or the dielectric duplexer can be further reduced in the axial direction of the resonator hole.

Furthermore, a slot may be provided on the first surface of the dielectric block. Depending on the size and shape of the slot, it is possible to change the resonator length of each dielectric resonator composed of one of the resonator holes, the outer conductor, and the dielectric block, and moreover, the coupling coefficients of the capacitive coupling and the inductive coupling between adjacent resonators.

Further, the mounting structure and the communication device of the present invention, equipped with at least one of the dielectric filters and the dielectric duplexer, can meet flexibly the requirement that the device should be reduced in height.

Other features and advantages of the present invention will become apparent from the following description of preferred embodiments of the invention which refers to the accompanying drawings, wherein like reference numerals indicate like elements to avoid duplicative description.

DESCRIPTION OF THE PREFERRED EMBODIMENTS

Figure 1:
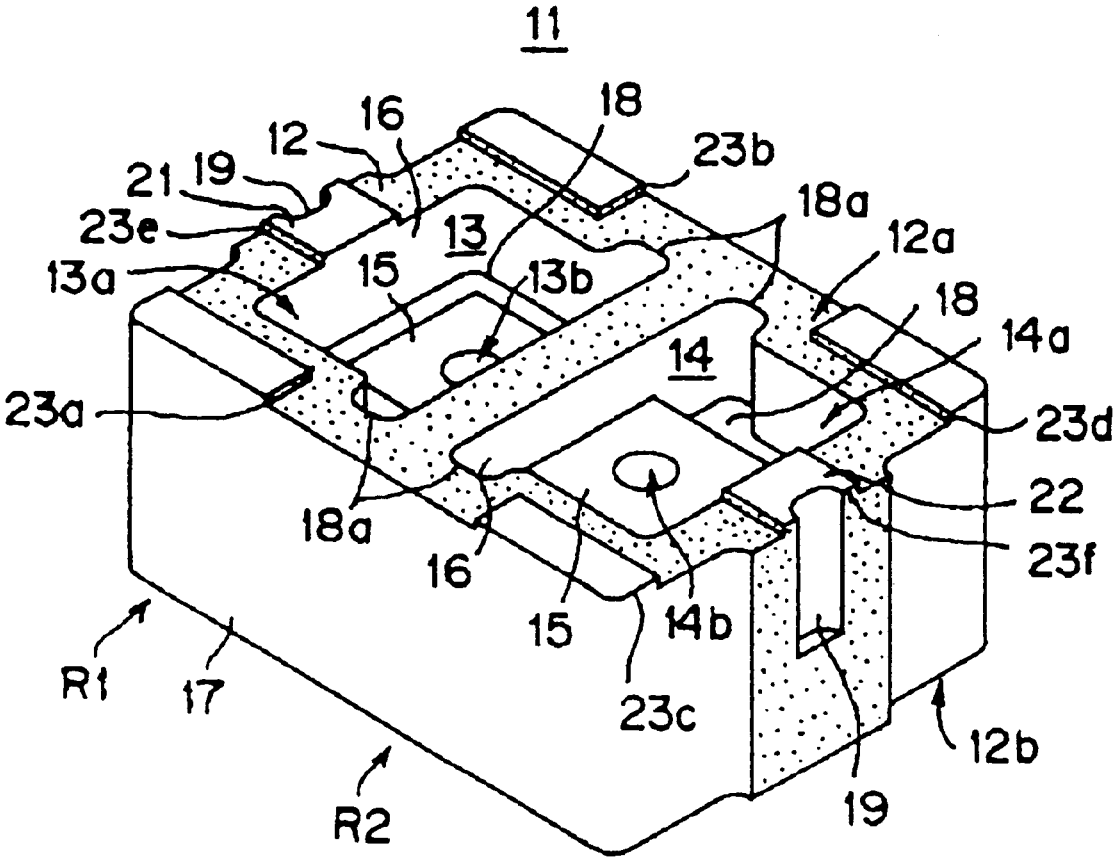
FIG. 1 is a perspective view of a dielectric filter according to a first preferred embodiment of the present invention.
Figure 2:
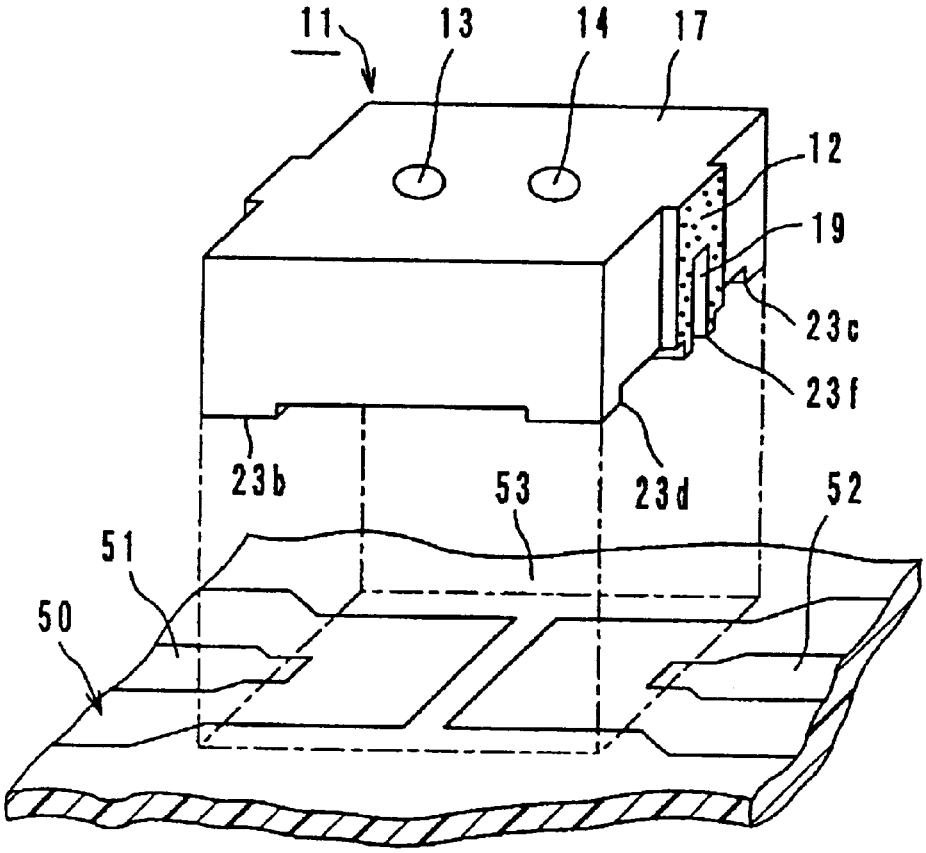
FIG. 2 is a perspective view of the dielectric filter shown in FIG. 1.
Figure 3:
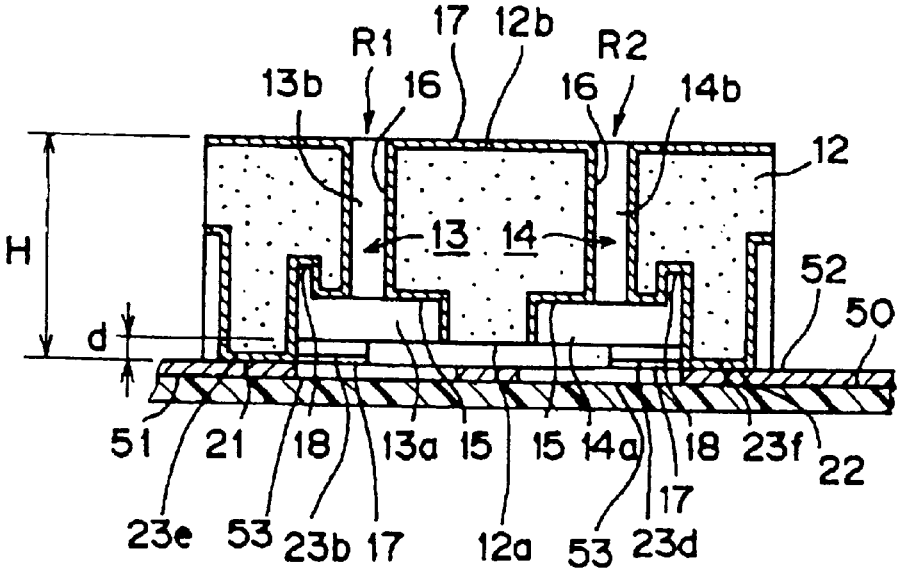
FIG. 3 is a cross-sectional view of the dielectric filter shown in FIG. 1.

First Preferred Embodiment, FIGS. 1 through 3

As shown in FIG. 1, a dielectric filter 11 comprises a single dielectric block 12 having a substantially rectangular parallelepiped shape. The dielectric block 12 has two resonator holes 13 and 14 which extend between the first and second surfaces 12*a*, 12*b* thereof opposite to each other. The resonator holes 13, 14 are so arranged in the single dielectric block 12 that their axes are in parallel to each other.

The resonator holes 13, 14 are composed of a large-sectional area portion 13*a* and a small-sectional area portion 13*b* having a circular cross-section and in communication with the large-sectional area portion 13*a*, and a large-sectional area portion 14*a* and a small-sectional area portion 14*b* having a circular cross-section and in communication with the large-sectional area portion 14*a*, respectively. In step portions 15 in the boundary areas between the large-sectional area portion 13*a* and the small-sectional area portion 13*b* and between the large-sectional area portion 14*a* and the small-sectional area portion 14*b*, depressions 18 are formed at a predetermined distance to the small-sectional area portions 13*b*, 14*b*, respectively. More particularly, the depressions 18 are so formed along the inner surfaces of the large-sectional area portions 13*a*, 14*a* excluding the parts of the inner walls thereof which are adjacent to each other as to surround about three-fourths of the circumferences of the small-sectional area portions 13*b*, 14*b*, respectively. The opposite ends 18*a* of each depression 18 are projected outwardly, so that the opposed areas of the adjacent parts of the resonator holes 13, 14 are increased. Thus, the coupling degree of the resonator holes 13, 14 can be enhanced.

An outer conductor 17 and a pair of input and output electrodes 21, 22 are provided on the outer surface of the dielectric block 12. Inner conductors 16 are provided on the inner surfaces of the resonator holes 13, 14, respectively. The outer conductor 17 is provided on the outer surface of the dielectric block 12 excluding the area where the input and output electrodes 21, 22 and the open-circuited first surface 12*a* where the large-sectional area portion portions 13*a*, 14*a* are open-circuited (hereinafter, referred to as an open-circuited surface 12*a*). A pair of the input and output electrodes 21, 22 are provided, not connected to the outer conductor 17. Moreover, one ends of the input and output electrodes 21, 22 are connected directly to the inner conductor 16, and the other ends are extended to lie on the inner surface of concave portions with a substantially semi-circular cross-section 19 which are provided in the side surfaces of the dielectric block 12, respectively.

In the open-circuited surface 12*a*, the inner conductors 16 are electrically left unconnected to the outer conductor 17 and connected to the inner and outer electrodes 21, 22, respectively. In the second surface 12*b* on the side where the small-sectional area portions 13*b*, 14*b* are short-circuited (hereinafter, referred to as a short-circuited surface 12*b*), the inner conductors 16 are electrically connected to the outer conductor 17. Thus, dielectric resonators R1, R2 are formed of the inner conductors 16 in the resonator holes 13, 14, and the outer conductor 17, respectively, provided in the single dielectric block 12.

Seat portions 23*a*, 23*b*, 23*c*, and 23*d* are provided in the four corners of the open-circuited surface 12*a* of the dielectric block 12, and seat portions 23*e*, 23*f* in the right- and left-hand edges thereof, respectively. The outer conductor 17 is extended to lie on the surfaces of the seat portions 23*a* through 23*d*, and the input and output electrodes 21, 22 are formed on the surfaces of the seat portions 23*e*, 23*f*, respectively.

As shown in FIGS. 2 and 3, the dielectric filter 11 having the above configuration is mounted to a circuit board 50 or the like of a communication device in its stable state by use of the seat portions 23*a* through 23*f* and the open-circuited surface 12*a* as the mounting face. That is, the filter 11 is so mounted by soldering or the like that the axes of the resonator holes 13, 14 are perpendicular to the circuit board 50. On the upper side of the circuit board 50, signal patterns 51 and 52 are provided in opposition to each other. Ground patterns 53 are provided on the opposite sides of the signal patterns 51 and 52, and have a bridge at a position between the signal patterns 51 and 52. The outer conductor 17 is extended to lie on the surfaces of the seat portions 23*a* through 23*d* to be electrically connected to the ground patterns 53 on the circuit board 50, respectively. The input and output electrodes 21, 22 provided on the surfaces of the seat portions 23*e*, 23*f* are electrically connected to the signal patterns 51, 52 on the circuit board 50, respectively.

The open-circuited surface 12*a* is so disposed that a gap (an air layer) is assured between the open-circuited surface 12*a* and the circuit board 50 by means of the seat portions 23*a* through 23*f*, not in direct contact with the circuit board 50. If the open-circuited surface 12*a* were in direct contact with the circuit board 50, a high stray capacitance would be produced between the open sides of the dielectric resonators R1, R2 and the ground pattern 53 of the circuit board 50, due to the high dielectric constant of the dielectric block 12. This high stray capacitance would unfavorably influence the characteristics of the dielectric filter. On the contrary, in the first embodiment, since the gap (air layer) is formed between the open-circuited surface 12*a* and the ground pattern 53 on the circuit board 50, the stray capacitance produced between the open sides of the dielectric resonators R1, R2 and the ground pattern 53 on the circuit board 50 can be reduced, due to the low dielectric constant of air. Thus, in the dielectric filter 11, influences with the stray capacitance can be inhibited. That is, the resonant frequencies of the dielectric resonators R1, R2 and the coupling coefficients of the capacitive coupling and the inductive coupling between the dielectric resonators R1, R2 can be stabilized. Moreover, the resonant frequencies of the dielectric resonators R1, R2 can be controlled by changing the heights d of the seat portions 23*a* through 23*f*.

The open-circuited surface 12*a* is opposed to the circuit board 50, not opposed to the other electronic components (not shown) mounted onto the circuit board 50. This is effective in preventing an electromagnetic field, leaking from the open-circuited surface 12*a*, from affecting the other electronic components. Similarly, this can inhibit an electromagnetic field, leaking from the other electronic components, from influencing the dielectric filter 11.

Further, in the resonator holes 13, 14, the step portions 15 are provided in the boundary areas between the large-sectional area portion 13*a* and the small-sectional area portion 13*b* and between the large-sectional area portion 14*a* and the small-sectional area portion 14*b*, respectively. The conductor paths of the inner conductors 16 are extended to lie on the surface of the steps 15, and thereby, are longer by an amount corresponding to the surfaces of the steps 15. Furthermore, the depressions 18 are provided in the steps 15, respectively. Therefore, the conductor path of each inner conductor 16 is longer as compared with the conventional dielectric filter not provided with the depressions 18. If the conductor path of the inner conductor 16 is longer, the center frequency of the dielectric filter 11 is lower. Accordingly, on condition that the center frequency is constant, the lengths in the axial direction of the resonator holes 13, 14 of the dielectric filter 11 can be reduced, as compared with the conventional dielectric filter. As a result, the mounting height H of the dielectric filter 11 can be reduced without reduction in the size of the resonator holes 13, 14.

Figure 4:
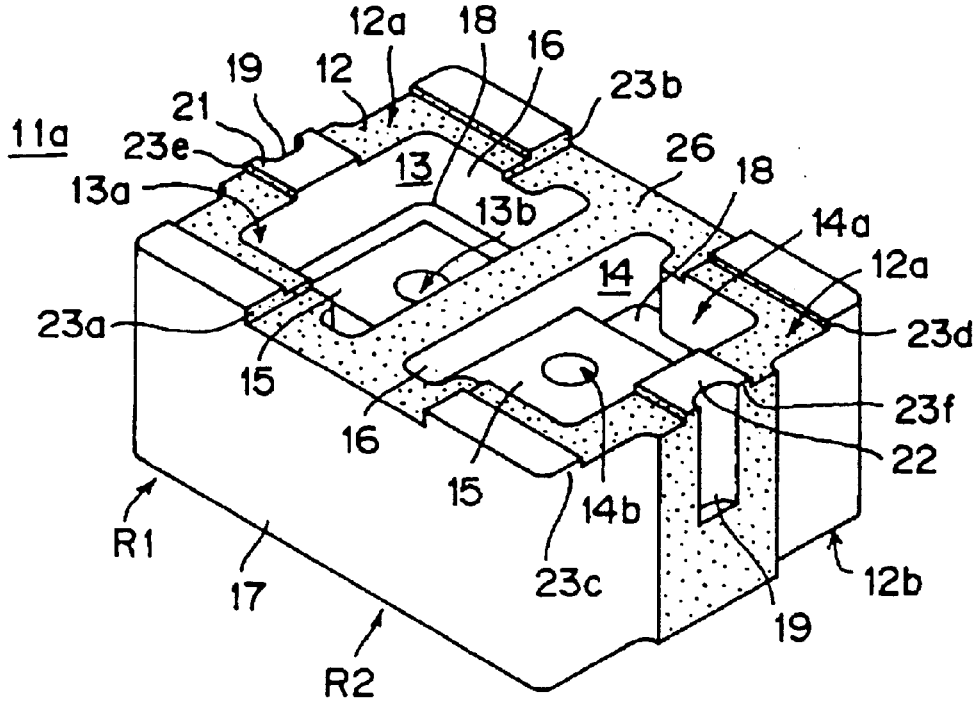
FIG. 4 is a perspective view of a dielectric filter according to a second preferred embodiment of the present invention.

Second Preferred Embodiment, FIG. 4

As shown in FIG. 4, a dielectric filter 11 a is the same as the dielectric filter 11 described in reference to FIG. 1, except for a slot 26 provided in the open-circuited surface 12*a* of the dielectric block 12. The slot 26 is so formed between the resonator holes 13, 14 that the slot 26 and a part of the respective resonator holes 13, 14 are overlapped each other.

The dielectric filter 11*a*, having the same advantages as those of the dielectric filter 11 of the first preferred embodiment, is further advantageous in that the coupling coefficients of the capacitive coupling and the inductive coupling between the adjacent dielectric resonators R1, R2 can be desirably controlled in correspondence to the depth and the shape and size of the slot 26, and thereby, the band width of the dielectric filter 11*a* can be easily controlled.

Figure 5:
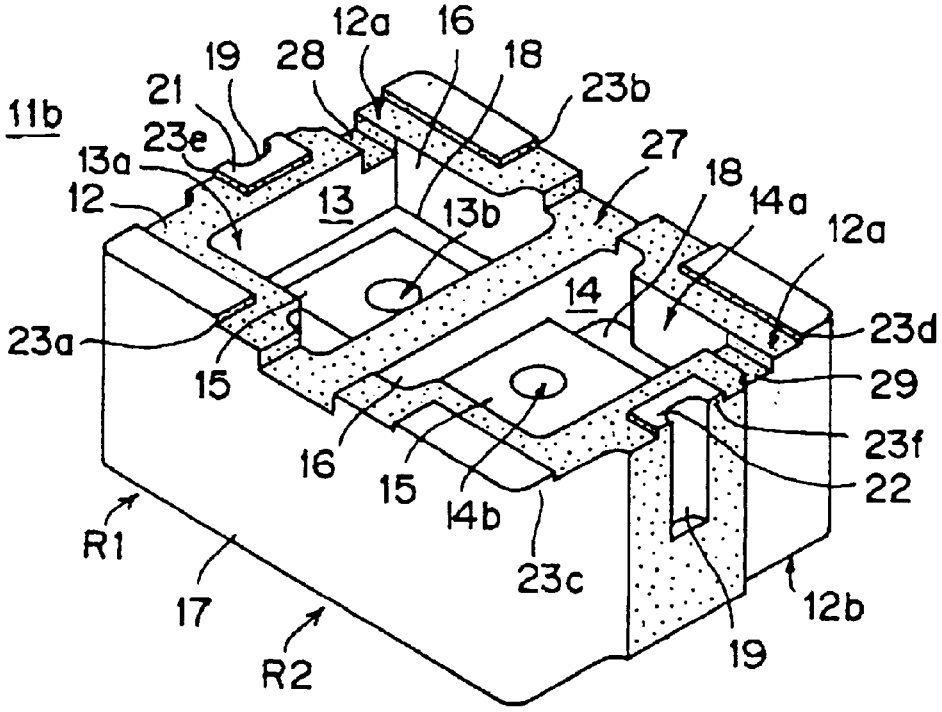
FIG. 5 is a perspective view of a dielectric duplexer according to a third preferred embodiment of the present invention.

Third Preferred Embodiment, FIG. 5

As shown in FIG. 5, a dielectric filter 11 b is the same as the dielectric filter 11 described in reference to FIG. 1 except for slots 27, 28, and 29 provided in the open-circuited surface 12*a* of the dielectric block 12. The slot 27 is so formed between the resonator holes 13, 14 that the slot 27 and a part of the resonator holes 13, 14 are overlapped each other. The slot 28 is formed near to the input and output electrode 21, with one end thereof in contact with the resonator hole 13. The slot 29 is formed near to the input and output electrode 22, with one end thereof in contact with the resonator hole 14. The depths of the slots 27 through 29 are set in conformity to the specifications of the dielectric filter 11*b*.

The dielectric filter 11*b*, having the same advantages as those of the dielectric filter 11 of the first preferred embodiment, is further advantageous in that the coupling coefficients of the capacitive coupling and the inductive coupling between the adjacent dielectric resonators R1, R2 can be desirably controlled in correspondence to the depth and the shape and size of the slot 27, and thereby, the band width of the dielectric filter 11*b* can be easily adjusted. In addition, advantageously, the resonator lengths of the dielectric resonators R1, R2 can be adjusted by changing the shape and size and the depth of the slots 28, 29, and thereby, the filter frequency of the dielectric filter 11*b* can be easily adjusted.

Fourth Preferred Embodiment, FIGS. 6 through 9

Figure 6:
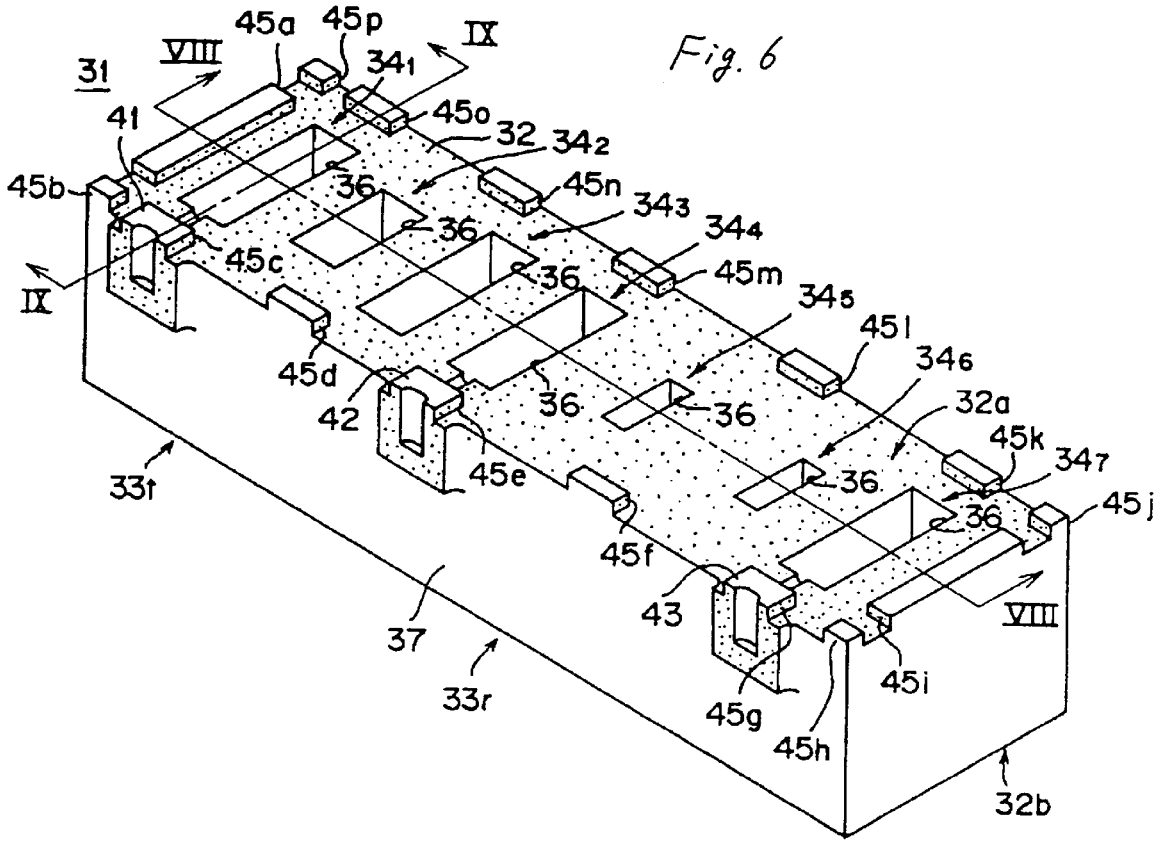
FIG. 6 is a perspective view of a dielectric filter according to a fourth preferred embodiment of the present invention.
Figure 7:
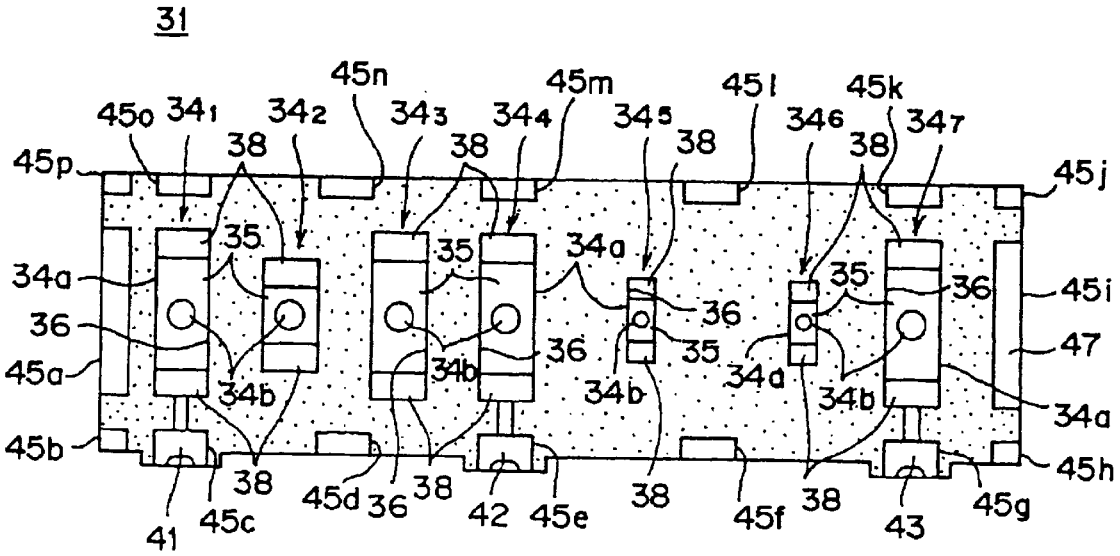
FIG. 7 is a plan view of the dielectric duplexer shown in FIG. 6.

FIGS. 6, 7, 8, and 9 are a perspective view of a dielectric duplexer according to a sixth preferred embodiment of the present invention, a plan view thereof, a cross sectional view taken along line VIII—VIII of FIG. 6, and cross-sectional view taken along line IX—IX of FIG.6, respectively. A dielectric duplexer 31 includes a single dielectric block 32 having a rectangular parallelepiped shape, and seven resonator holes $\mathbf{34}_1$ through $\mathbf{34}_7$ extending between the first and second surfaces 32*a* and 32*b* of the dielectric block which are opposed to each other. The resonator holes $\mathbf{34}_1$ through $\mathbf{34}_7$ are so arranged with the axes thereof in parallel to each other as to form one line in the dielectric block 32.

Figure 8:
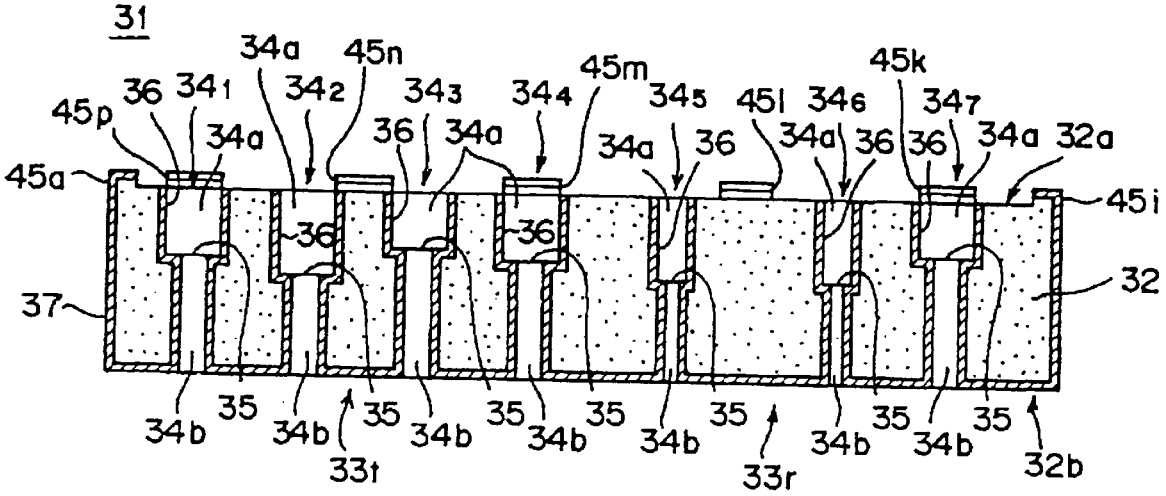
FIG. 8 is a cross sectional view taken along line VIII—VIII of FIG. 6.
Figure 9:
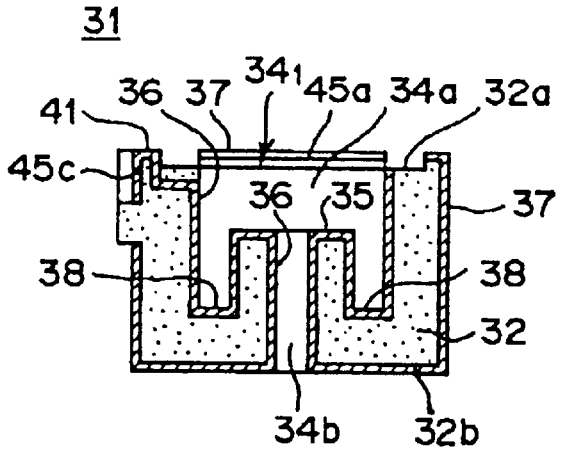
FIG. 9 is a cross-sectional view taken along line IX—IX.

The resonator holes $\mathbf{34}_1$ through $\mathbf{34}_7$ each comprises a large-sectional area portion 34*a* having a rectangular cross-section and a small-sectional area portion 34*b* in communication with the large-sectional area portion 34*a* (see FIG. 8). In a step portion 35 in the boundary area between the large-sectional area portion 34*a* and the small-sectional area portion 34*b*, depressions 38 are formed at the opposite ends of the large-sectional area portion 34*a*, respectively (see FIG. 9). The size of the resonator holes $\mathbf{34}_1$ through $\mathbf{34}_1$ and the size and depth of the depressions 38 are so set individually that the duplexer 31 has required electric characteristics. That is, the shape and size of each of the resonator holes $\mathbf{34}_1$, $\mathbf{34}_3$, $\mathbf{34}_4$, and $\mathbf{34}_7$ is set large, while that of each of the resonator holes $\mathbf{34}_5$, $\mathbf{34}_6$ are set small. The resonator hole $\mathbf{34}_2$ is so set as to have a size and shape which is intermediate between those of the resonator holes $\mathbf{34}_1$, $\mathbf{34}_6$. Further, the mutual distances between the resonator holes $\mathbf{34}_5$, through $\mathbf{34}_7$ are set to conform to the specifications of the dielectric duplexer.

The four resonator holes $\mathbf{34}_1$ through $\mathbf{34}_4$ arranged in the area of the duplexer 31 which lies in one half of thereof on the left-hand side are electromagnetically coupled with each other to constitute a transmission side filter 33*t*. Similarly, the four resonator holes $\mathbf{34}_4$ through $\mathbf{34}_7$ arranged in the area of the duplexer 31 which lies in one half thereof on the right-hand side are electromagnetically coupled with each other to constitute a reception side filter 33*r*.

An outer conductor 37, a transmission electrode 41, an antenna electrode 42, and a reception electrode 43 are formed on the outside of the dielectric block 32. Inner conductors 36 are formed on the inner surfaces of the resonator holes $\mathbf{34}_1$ through $\mathbf{34}_7$, respectively. The outer conductor 37 is formed on the outside of the dielectric block 32 excluding the area where the electrodes 41 through 43 are provided and the first surface 32*a* on the side where the large-sectional area portions 34*a* open (hereinafter, referred to as the open-circuited surface 32*a*). The transmission electrode 41 is connected directly to the inner conductor 36 of the resonator hole 34,. The antenna electrode 42 is connected directly to the inner conductor 36 of the resonator hole $\mathbf{34}_4$. The reception electrode 43 is connected directly to the inner conductor 36 of the resonator hole $\mathbf{34}_7$.

Each inner conductor 36 is electrically left unconnected to the outer conductor 37 at the open-circuited surface 32*a*, and is short-circuited (electrically connected) to the outer conductor 37 at the surface on the side where the small-sectional area portions 34*b* open (hereinafter, referred to as a short-circuiting side surface 32*b*). Thus, the dielectric resonators each are formed of the dielectric block 32, each inner conductor 36 of the resonator holes $\mathbf{34}_1$ through $\mathbf{34}_7$, and the outer conductor 37, respectively.

Seat portions 45*a* through 45*p* are provided in the peripheral area of the open-circuited surface 32*a* of the dielectric block 32. The outer conductor 37 is extended to lie on the surfaces of the seat portions 45*a*, 45*b*, 45*d*, 45*f*, and 45*h* through 45*p*. The transmission electrode 41 is formed on the surface of the seat portion 45*c*, the antenna electrode 42 on the surface of the seat portion 45*e*, and the reception electrode 43 on the surface of the seat portion 45*g*.

The dielectric duplexer 31, having the above described configuration, is mounted, with the open-circuited surface 32*a* used as the mounting surface, onto a circuit board or the like in its stable state by use of the seat portions 45*a* through 45*p*. That is, the duplexer 31 is so mounted onto the circuit board that the axes of the resonator holes $\mathbf{34}_1$ through $\mathbf{34}_7$ are substantially perpendicular to the circuit board. When the duplexer is mounted, the open-circuited surface 32*a* is so disposed as to assure a gap (air layer) between the open-circuited surface 32*a* and the circuit board, by means of the seat portions 45*a* through 45*p*, avoiding the direct contact with the circuit board. Accordingly, stray capacitance between the open side surfaces of the dielectric resonators contained in the dielectric duplexer 31 and a ground pattern of the circuit board can be reduced. Thus, in the dielectric duplexer 31, the stray capacitance can be inhibited from exerting an influence. The resonant frequencies of the respective dielectric resonators and the coupling coefficients of the capacitive coupling and the inductive coupling between the mutual dielectric resonators can be stabilized. In addition, the resonant frequencies of the dielectric resonators can be adjusted by changing the height of the seat portions 45*a* through 45*p*.

The open-circuited surface 32*a* is opposed to the circuit board, not opposed to the other electronic components mounted onto the circuit board. This is effective in preventing an electromagnetic field, leaking from the open-circuited surface 32*a*, from affecting other electronic components. Similarly, this can inhibit an electromagnetic field, leaking from the other electronic components, from exerting an influence over the dielectric duplexer 31.

Further, in each of the resonator holes $\mathbf{34}_1$ through $\mathbf{34}_7$, the step portion 35 is formed in the boundary area between the large-sectional area portion 34*a* and the small-sectional area portion 34*b*. The conductor path of the inner conductor 36, which is extended to lie on the surface of the step 35, is longer by an amount corresponding to the surface of the step 35. Furthermore, the depression 38 is provided in the step 35. Therefore, the conductor path of the inner conductor 36 is longer as compared with the conventional dielectric filter not provided with the depressions 38. If the conductor length of the inner conductors 36 is longer, the center frequencies of the dielectric resonators contained in the dielectric duplexer 31 is longer. The conductor length of the inner conductors 36 is lengthened. Accordingly, on condition that the center frequency is constant, the length in the axial direction of the resonators 34, through $\mathbf{34}_7$ of the dielectric duplexer 31 can be made shorter than the conventional dielectric duplexer. As a result, the mounting height of the dielectric duplexer 31 can be reduced without reduction in the size of the resonator holes $\mathbf{34}_1$ through $\mathbf{34}_7$.

Figure 10:
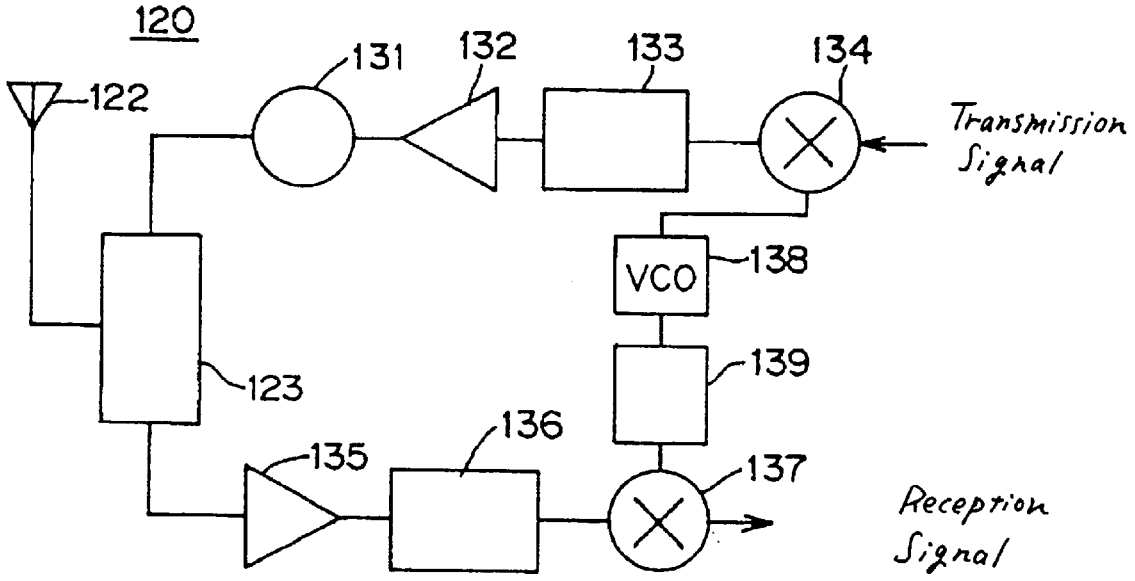
FIG. 10 is a block diagram of a communication device according to a fifth preferred embodiment of the present invention.
Figure 11:
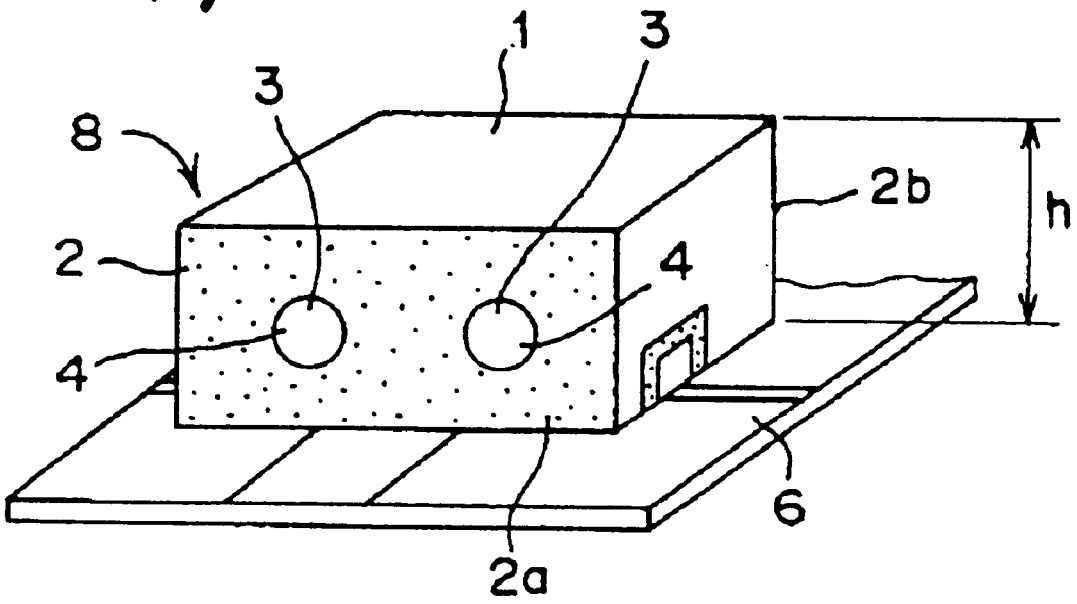
Fig. 11 PRIOR ART
FIG. 11 is a perspective view of a conventional dielectric filter.

Fifth Preferred Embodiment, FIG. 10

A communication device embodying the present invention will be described in the following fifth preferred embodiment taking a portable telephone for an example.

FIG. 10 is an electric circuit block diagram showing the RF section of a portable telephone 120. In FIG. 10, there are indicated an antenna element by reference numeral 122, a filter (duplexer) for use with the antenna by 123, a transmission side isolator by 131, a transmission side amplifier by 132, a transmission-side interstage band-pass filter by 133, a transmission side mixer 134, a reception side amplifier by 135, a reception side interstage band-pass filter by 136, a reception side mixer by 137, a voltage controlling oscillation device (VCO) by 138, and a local band-pass filter by 139.

In the above configuration, as the filter (duplexer) for use with the antenna 123, is available, for example, the dielectric duplexer 31 of the above-described fourth embodiment. Further, as the transmission side interstage band-pass filter 133, the reception side interstage band-pass filter 136, and the local band-pass filter 139, can be used, for example, the dielectric filters 11, 11*a*, and 11*b* of the first, the second, and the third preferred embodiment. The RF section can be reduced in height by mounting the dielectric duplexer 31 and the dielectric filters 11, 11*a*, and 11*b*. Thus, the portable telephone of a thin type can be realized.

Other Preferred Embodiments

The dielectric filter, the dielectric duplexer, the structure having the same mounted therein, and the communication device of the present invention may be modified in all respects without departing from the scope of the invention, not restricted to the above-described embodiments. For example, in the dielectric duplexer 31 of the fourth embodiment, the open-circuited surface 32*a* may be provided with a slot. The large-sectional area portions and the small-sectional area portions provided in the dielectric filter and the dielectric duplexer may have an optional shape and size in their cross-sections. The shape and size of the depressions may be optionally changed in correspondence to the shape and size of the cross-sections.

As apparently understood in the above description, according to the present invention, the size of the dielectric filter or dielectric duplexer can be reduced in the axial direction of the resonator holes, and the mounting height can be decreased without changes in the conductor path of the inner conductor, due to the steps formed in the boundary areas between the large-sectional area portions and the small-sectional area portions of the resonator holes. When the dielectric filter or the dielectric duplexer is mounted onto the circuit board, the gap is formed between the first surface of the dielectric block, which is the mounting face of the filter or the duplexer, and the circuit board or the like, due to the seat portions provided on the first surface of the dielectric block. With the gap, the stray capacitance to be produced between the first surface of the dielectric block and the circuit board can be reduced.

Moreover, the first surface, which is the open-circuited surface, is opposed to the circuit board. This inhibits an electromagnetic field leaking from the first surface from affecting the other electronic components mounted onto the circuit board. Similarly, this inhibits an electromagnetic filed, leaking from the other electronic components, from exerting an influence over the dielectric filter or the dielectric duplexer. Further, the seat portions provided on the first surface are effective in mounting the dielectric filter or the dielectric duplexer on the circuit board in its stable state. Moreover, the depressions provided in the steps between the large-sectional area portions and the small-sectional area portions enable the size of the dielectric filter or the dielectric filter to be further reduced in the axial direction of the resonator holes. As a result, the mounting height of the dielectric filter or the dielectric duplexer can be further reduced.

The coupling coefficients of the capacitive coupling and the inductive coupling between of adjacent resonator holes, and moreover, the resonator length of the dielectric resonators can be changed by providing the slot in the first surface of the dielectric block and changing the depth and shape of the slot.

The communication device and the mounting structure of the present invention, as it is equipped with at least one of the dielectric filter or the dielectric duplexer having the above-stated characteristics, can flexibly satisfy the requirement of the thin type communication device.

While the invention has been particularly shown and described with reference to preferred embodiments thereof, it will be understood by those skilled in the art that the forgoing and other changes in form and details may be made therein without departing from the spirit of the invention.

What is claimed is:

1. A communication device comprising:

a dielectric block including a first surface and a second surface opposite to each other;

a resonator hole extending between the first surface and the second surface of the dielectric block, said resonator hole including a large-sectional area portion, a small-sectional area portion and a step portion between the large-sectional area portion and the small-sectional area portion;

an inner conductor provided on the inner surface of the resonator hole;

an outer conductor provided on the outer surface of the dielectric block, whereby said resonator hole in said dielectric block provides a dielectric filter;

the inner conductor being electrically left unconnected to the outer conductor at the first surface of the dielectric block so as to provide an open-circuited surface of said dielectric block, and being electrically connected to the outer conductor at the second surface of the dielectric block so as to provide a short-circuited surface of said dielectric block; and a seat portion provided on at least one of a comer and an edge of the first surface of the dielectric block, wherein said seat portion serves as a mounting surface of the dielectric block, and wherein said seat portion defines a gap between said open-circuited surface and said mounting surface.

2. The communication device according to claim 1, wherein the step portion between the large-sectional area portion and the small-sectional area portion of the resonator hole is provided with a depression.

3. The communication device according to claim 1, wherein the first surface of the dielectric block is provided with a slot.

4. The communication device according to claim 1, comprising:

a plurality of resonator holes, including said resonator hole extending between the first surface and the second surface of the dielectric block;

each said resonator hole including a large-sectional area portion, a small-sectional area portion and a step portion between the large-sectional area portion and the small-sectional area portion; an inner conductor provided on the inner surface of the resonator hole; an outer conductor provided on the outer surface of the dielectric block; the inner conductor being electrically left unconnected to the outer conductor at the first surface of the dielectric block and being electrically connected to the outer conductor at the second surface of the dielectric block; and a seat portion provided on the first surface of the dielectric block, wherein said plurality of resonator holes in said dielectric block provide a plurality of dielectric filters; and wherein the seat portion serves as a mounting surface of the dielectric block; and wherein at least one resonator hole of said plurality of resonator holes provides a transmitting filter and another resonator hole of said plurality of resonator holes provides a receiving filter, said transmitting and receiving filters having different respective resonant frequencies.

5. The communication device according to claim 4, wherein the step portion between the large-sectional area portion and the small-sectional area portion of each said resonator hole is provided with a depression.

6. The communication device according to claim 1, further comprising a circuit board mounted to said mounting surface of the dielectric block.

7. The communication device according to claim 2, further comprising a circuit board mounted to said mounting surface of the dielectric block.

8. The communication device according to claim 3, further comprising a circuit board mounted to said mounting surface of the dielectric block.

9. The communication device according to claim 4, further comprising a circuit board mounted to said mounting surface of the dielectric block.

10. The communication device according to claim 5, further comprising a circuit board mounted to said mounting surface of the dielectric block.

11. The communication device of claim 1, further comprising a transmitting circuit and a receiving circuit, said dielectric filter being included in at least one of said transmitting circuit and said receiving circuit.

12. The communication device of claim 2, further comprising a transmitting circuit and a receiving circuit, said dielectric filter being included in at least one of said transmitting circuit and said receiving circuit.

13. The communication device of claim 3, further comprising a transmitting circuit and a receiving circuit, said dielectric filter being included in at least one of said transmitting circuit and said receiving circuit.

14. The communication device of claim 6, further comprising a transmitting circuit and a receiving circuit, said dielectric filter being included in at least one of said transmitting circuit and said receiving circuit.

15. The communication device of claim 7, further comprising a transmitting circuit and a receiving circuit, said dielectric filter being included in at least one of said transmitting circuit and said receiving circuit.

16. The communication device of claim 4, further comprising a transmitting circuit and a receiving circuit, said transmitting circuit being connected to said transmitting filter and said receiving circuit being connected to said receiving filter.

17. The communication device of claim 5, further comprising a transmitting circuit and a receiving circuit, said transmitting circuit being connected to said transmitting filter and said receiving circuit being connected to said receiving filter.

18. The communication device of claim 9, further comprising a transmitting circuit and a receiving circuit, said transmitting circuit being connected to said transmitting filter and said receiving circuit being connected to said receiving filter.

19. The communication device of claim 10, further comprising a transmitting circuit and a receiving circuit, said transmitting circuit being connected to said transmitting filter and said receiving circuit being connected to said receiving filter.

* * * * *